US007691038B2

(12) United States Patent
Shearer

(10) Patent No.: US 7,691,038 B2
(45) Date of Patent: Apr. 6, 2010

(54) CONVERTIBLE GYM TRAINING DEVICE AND CORRESPONDING WEIGHT-TRAINING BENCH

(76) Inventor: Stuart Laurence Shearer, 12 Langwell Crescent, Ashington, Northumberland (GB) NE63 8AB ( * ) Notice: Subject to any disclaimer, the term of this patent is extended or adjusted under 35 U.S.C. 154(b) by 0 days.

(21) Appl. No.: 11/959,457

(22) Filed: Dec. 18, 2007

(65) Prior Publication Data

US 2008/0153679 A1 Jun. 26, 2008

(30) Foreign Application Priority Data

Dec. 22, 2006 (FR) ..... 06 11349

(51) Int. Cl.
*A63B 21/04* (2006.01)

(52) U.S. Cl. ..... 482/130; 482/123; 482/137

(58) Field of Classification Search ..... 482/92–94, 482/98–102, 121–125, 128–130, 133–139, 482/145, 905; 273/451, 452
See application file for complete search history.

(56) References Cited

U.S. PATENT DOCUMENTS 190,149 A * 5/1877 Lozier ..... 482/128
4,310,155 A * 1/1982 White ..... 482/79
4,575,076 A * 3/1986 Reichert et al. ..... 273/453
4,807,874 A * 2/1989 Little ..... 482/80
5,002,271 A * 3/1991 Gonzales ..... 482/130
5,039,092 A 8/1991 Olschansky et al.
5,087,038 A * 2/1992 Hao et al. ..... 482/130
5,102,121 A * 4/1992 Solow et al. ..... 482/94
5,170,777 A * 12/1992 Reddy et al. ..... 601/33
5,190,509 A * 3/1993 Davison, Jr. ..... 482/100
5,284,464 A * 2/1994 Lee et al. ..... 482/121
5,308,304 A * 5/1994 Habing ..... 482/99
5,336,148 A * 8/1994 Ish, III ..... 482/98
5,354,252 A * 10/1994 Habing ..... 482/100
5,468,202 A * 11/1995 Habing ..... 482/100
5,486,150 A * 1/1996 Randolph ..... 482/133
5,558,624 A * 9/1996 Hepburn et al. ..... 601/33
5,603,681 A * 2/1997 Olschansky et al. ..... 482/129
5,605,523 A * 2/1997 Ish et al. ..... 482/99
5,616,111 A * 4/1997 Randolph ..... 482/133
5,624,353 A * 4/1997 Naidus ..... 482/5
5,720,702 A * 2/1998 Lee ..... 482/129

(Continued)

FOREIGN PATENT DOCUMENTS

GB 2160785 A * 1/1986

*Primary Examiner*—Loan H Thanh
*Assistant Examiner*—Daniel F Roland
(74) *Attorney, Agent, or Firm*—Shewchuk IP Services, LLC; Jeffrey D. Shewchuk

(57) ABSTRACT

The invention concerns a convertible gym training device intended to be removably connected to a weight-training device that permits training of lower and upper body limbs.

According to the invention, such a convertible gym training device in particular comprises:

an essentially quadrangular frame (1014);

an arm actuator (107) rotatably connected to the said frame (1014);

resilient return means (40) opposing a force against the rotation of the said arm actuator (107) relatively to the said frame (1014);

mechanical link means (400) connecting the said arm actuator (107) with the said resilient return means (40), said mechanical link means (400) being designed to oppose a variable back moving force against the said arm actuator (107), all along its rotation travel, said back moving force being variable according to a predetermined load curve.

11 Claims, 11 Drawing Sheets

U.S. PATENT DOCUMENTS

| | | | | |
|---|---|---|---|---|
| 5,722,921 | A * | 3/1998 | Simonson | 482/100 |
| 5,895,343 | A * | 4/1999 | Huang | 482/123 |
| 5,984,844 | A * | 11/1999 | Royer | 482/133 |
| 6,340,342 | B1 | 1/2002 | Lee | |
| 6,436,018 | B2 * | 8/2002 | Pellis | 482/136 |
| 6,443,874 | B1 * | 9/2002 | Bennett | 482/44 |
| 6,645,129 | B2 * | 11/2003 | Eschenbach | 482/140 |
| 6,682,465 | B2 * | 1/2004 | Hawthorne | 482/121 |
| 6,958,032 | B1 * | 10/2005 | Smith et al. | 482/121 |
| 7,282,015 | B1 * | 10/2007 | White | 482/94 |
| 7,357,759 | B2 * | 4/2008 | Bonnell | 482/72 |
| 7,537,551 | B2 * | 5/2009 | Steffee | 482/100 |
| 2002/0025893 | A1 * | 2/2002 | Pellis | 482/136 |
| 2002/0183175 | A1 * | 12/2002 | Tang | 482/121 |
| 2003/0087736 | A1 | 5/2003 | Carter et al. | |
| 2005/0101455 | A1 * | 5/2005 | Chen | 482/121 |
| 2006/0128535 | A1 * | 6/2006 | Smith | 482/94 |
| 2007/0184944 | A1 * | 8/2007 | Huang | 482/94 |

* cited by examiner

CONVERTIBLE GYM TRAINING DEVICE AND CORRESPONDING WEIGHT-TRAINING BENCH

1. FIELD OF THE INVENTION

The invention relates to the field of sport practice and especially to the field of muscular training.

More particularly, the invention relates to muscular training equipments and to weight-training machines.

2. PRIOR ART

Weight-training machines are well known. There are different types of such weight-training machines for exercising various body muscles.

According to a first type of weight-training machine, such machines are composed of a support for supporting a user (in a standing, sitting or lying position), frequently a simple "bench", and weights that are totally independent of the support and that are displaced by the user.

According to a second type of weight-training machine, weights being displaced by the user are integrated in a mechanism being part of the weight-training machine itself.

Machines of such second type can are divided again into two different sub-categories.

A first sub-category consists of weight-machines called linear load weight-training machines in which the value of the load displaced by a user is constant during a given exercise. This type of machine does not enable to train all kinds of body muscles. Actually, body mechanical system with which we lift objects involve the use of both muscles for forces and bones for levers. In fact, the load that a muscle is able to displace depends on the inclination of bones. In relation to FIG. 1*a* which illustrates the relationship between tension developed during contraction and angle of pull of muscle on the bone to which it is attached, it can be seen that the load able to be displaced during knee flexion increases with the angle of flexion of the knee. In relation to drawing 1*b*, it can be seen similarly that the load able to be displaced during shoulder extension increases and then decreases.

Recognizing this problem, weight-training machines were developed to compensate for this disadvantage in weight training while lifting constant loads.

The second sub-category of machine of that second type concerns weight-training machines called variable load weight-training machines. Such weight-training machines use different technologies. Some of such machines use hydraulic oil displacement systems to provide partial accommodating resistance. Others machines use electro-servo braking to provide accommodating resistance.

A disadvantage of such variable load weight-training machines is that they are quite big, heavy and encumbering.

Another disadvantage of such variable load weight-training machines is that the different technologies they use are complex and expensive.

Finally, such variable load weight-training machines present the disadvantage that they are each generally designed for a limited usage. Actually, such machines usually only allow either upper or under limb working exercises. For example, different weight-training machines need to be used for shoulder training, arm training, leg training. . . .

3. AIM OF THE INVENTION

The invention aims in particular to obviate these above disadvantages of the prior art.

More particularly, the invention aims to provide such a weight-training machine that is able to provide a variable load during a training exercise.

Another objective of the invention is to provide a single weight-training machine that permits training of a series of various groups of body muscles (lower and upper limb working exercises).

The invention aims to provide such a weight-training machine that is cheap to manufacture and simple to implement.

The invention aims also to provide such a weight-training machine that is portable and may be simply arranged onto any kind of simple bench.

Another objective of the invention is to provide such a weight-training machine that can be used both at home and in musculation room and is ergonomic and simple to use.

Another objective of the invention is to provide such a weight-training machine that can be used as well by a strong adult user, by a weaker child user, and any other type of user.

4. SUMMARY OF THE INVENTION

Those objectives, and other that will appear thereafter, are achieved by a convertible gym training device intended to be removably connected to a weight-training device that permits training of lower and upper body limbs.

According to the invention, such a convertible gym training device comprises:

- an essentially quadrangular frame (1014);
- an arm actuator (107) rotatably connected to the said frame (1014);
- resilient return means (40) opposing a force against the rotation of the said arm actuator (107) relatively to the said frame (1014);
- mechanical link means (400) connecting the said arm actuator (107) with the said resilient return means (40), said mechanical link means (400) being designed to oppose a variable back moving force against the said arm actuator (107), all along its rotation travel, said back moving force being variable according to a predetermined load curve, the said mechanical link means (400) comprising a connecting rod (51) cooperating with a drive plate (55), said connecting rod (51) comprising:
  - a connecting rod head (512) fixedly connected to said drive plate (55) according to one of at least two removable locking positions, each of said two removable locking positions corresponding to a different predetermined variable load curve for said back moving force;
  - a connecting rod eye (511) acting on said resilient return means (40) via a first transmission sub-assembly (46, 48), and in that said drive plate (55) is driven in rotation by a second transmission sub-assembly (62, 63, 64), said second transmission sub-assembly being connected to said arm actuator (107).

The invention rests on a new and inventive principle that allow a user to do lower and upper limb working exercises with a single weight-training machine on witch is connected a convertible gym training device according to the invention.

To makes it possible, the convertible gym training device according to the invention permits that a load a user needs to displace during a training exercise varies according to predetermined curve of load depending on the group of muscles he wants to train. Such a device according to the invention has notably good ergonomical qualities.

Such a device may be simply arranged onto any kind of simple bench and is not encumbering.

According to an attractive feature of the invention, said first transmission sub-assembly comprises a load transmission linkage mechanism (46, 48) for transmitting said variable back moving force, said linkage mechanism (46, 48) being adjustable according to one of at least two positions, each said positions corresponding to a different intensity for the load curve of said variable back moving force which is transmitted.

In this way, the user can adapt reference load that is the maximum load he will displace during a training exercise, to its power.

According to a preferential feature of the invention, the said linkage mechanism comprises:

an articulated rod (46), said articulated rod (46) having a first end (463) and a second end (462), said first end (463) being connected to the resilient return means (40), and said second end (462) being slidably connected relatively to the said frame (1014), the said articulated rod (46) having a guiding slot (461) extending along at least a part of its length;

an adjustment lever (48) having a first extremity (481) and a second extremity (482), said first extremity (481) being guided along said guiding slot (461), said second extremity (482) being rotatably connected to said frame (1014).

This simple linkage mechanism allows a user to adapt the reference load only by rotating and guiding said adjustment lever along said guiding slot.

Preferentially, said second transmission sub-assembly comprises a drive wheel (62), said drive wheel (62) cooperating with said drive plate (55) and comprising at least one drive pin (60, 61), said drive pin (60, 61) being able to drive said drive plate (55).

This simple second transmission sub-assembly allows activating said mechanical link means. It also allows changing the value of the back moving force according to a predetermined load curve all along training exercises the user wants to do and according to the body muscle group that are involved in this type of training exercises. This variation is obtained by modifying along an exercise the arm lever by which the drive plate acts on the connecting rod.

Attractively, said drive plate (55) has at least one cam profile (551, 552), and said drive wheel (62) comprises two drive pins (60, 61) that are symmetrically positioned, at least one of the drive pins (60, 61) guiding the movement of said drive plate (55) by engaging said cam profile (551, 552), while the other drive pin (61, 62) drives said drive plate (55).

This feature of the invention allows the user to rotate the arm actuator in two opposite direction in accordance with the type of training exercise he wants to do (push, pull).

Preferentially, a first drive cog (63) is solidably connected to said arm actuator (107), and said drive wheel (62) consists of a second idler drive (62) which is rotatably connected relatively to said frame (1014) and acts on said drive plate (55) when said arm actuator (107) is pivoted relatively to the said frame (1014), said first drive cog (63) engaging said second idler drive (62) by means of a driving chain (64).

This simple transmission mechanism allows transmitting the variable back moving force to the user who acts on the arm actuator.

According to an attractive feature of the invention, said drive wheel (62) and said drive plate (55) are set coaxially to each other when said arm actuator (107) stands in a rest position, said rest position corresponding to a neutral position in which said resilient return means (40) do not oppose any force against the rotation of the said arm actuator (107) relatively to the said frame (1014).

The invention also concerns a weight-training bench that comprises a bench to which is affixed a convertible gym training device according to the invention.

5. BRIEF DESCRIPTION OF THE DRAWINGS

Further advantages and features of the invention can be gathered from the following description of preferred embodiments of the invention, the claims and the attached drawings, wherein show:

FIGS. 1*a* and 1*b* illustrate two graphics explaining respectively the relationship between the tension developed during contraction of a muscle and the angle of pull of the bone to which it is attached in the case of knee flexion and shoulder extension;

FIG. 2 generally illustrates one embodiment of a convertible gym training device according to the invention that is connected to a weight-training machine;

Figure 13A:
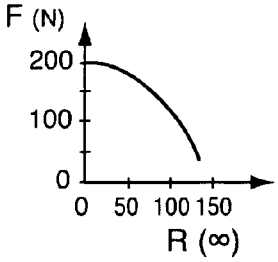
Figure 8A:
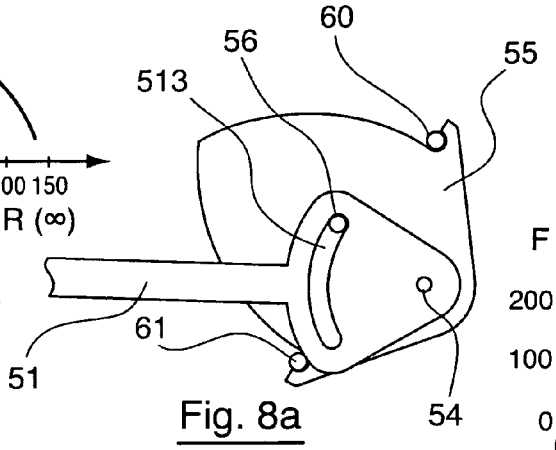
Figure 13B:
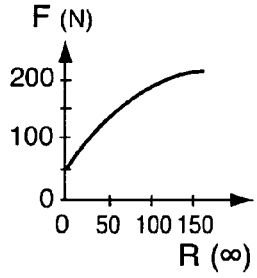
Figure 8B:
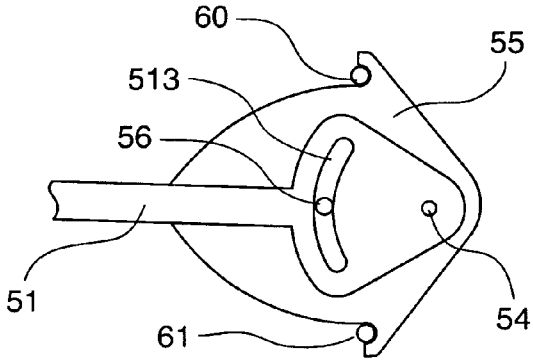
Figure 14:
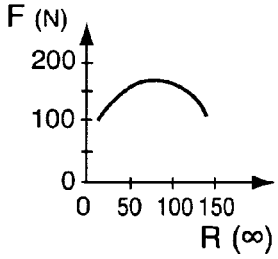
Figure 8C:
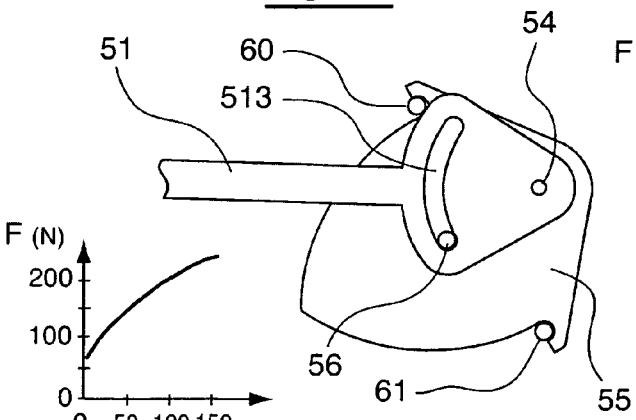
Figure 15B:
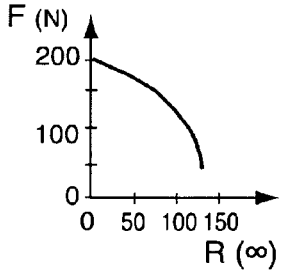
Figure 15A:
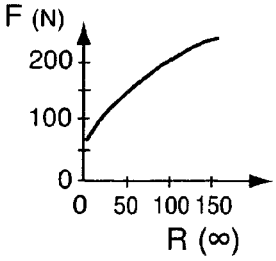
Figure 9A:
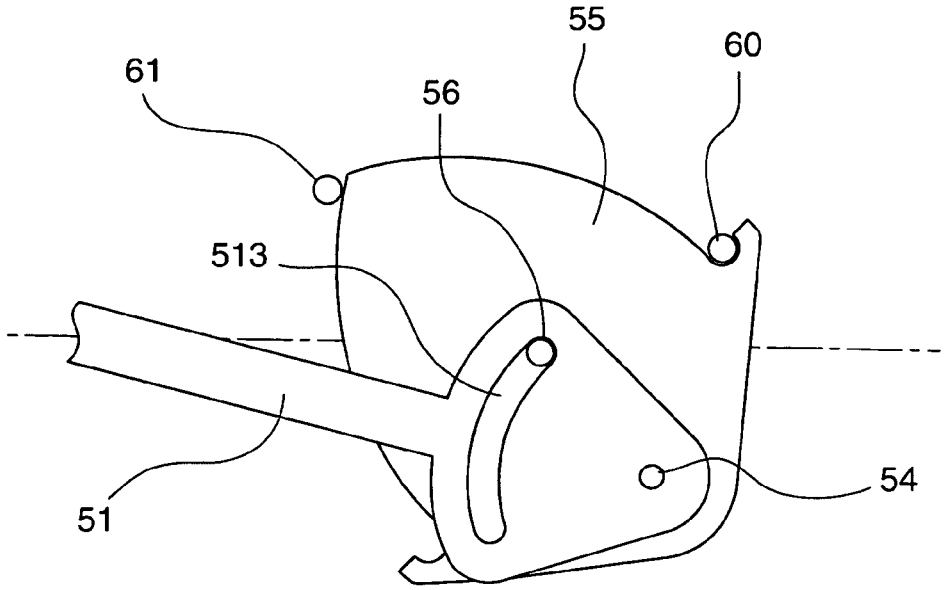
Figure 9B:
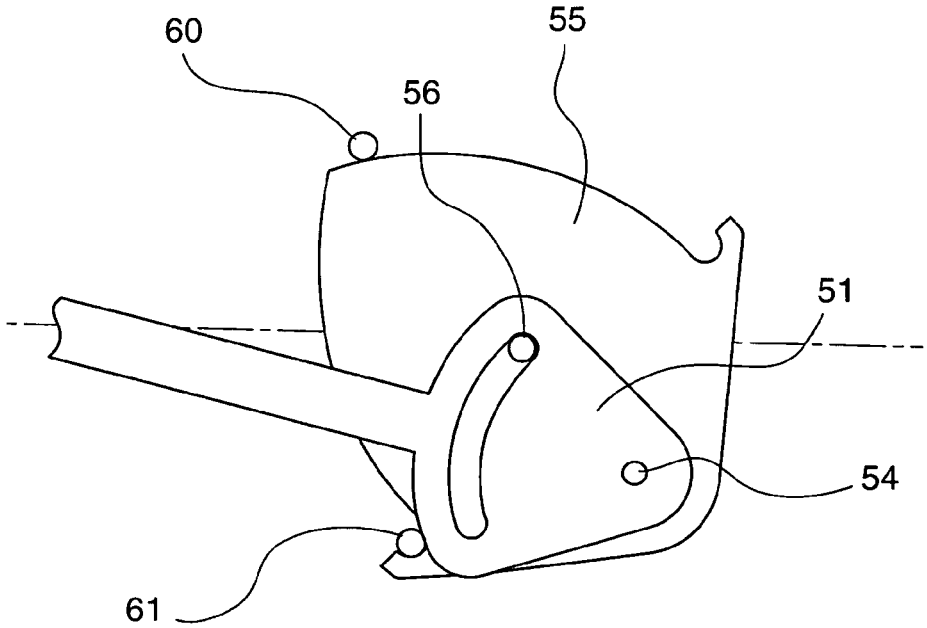
Figure 10A:
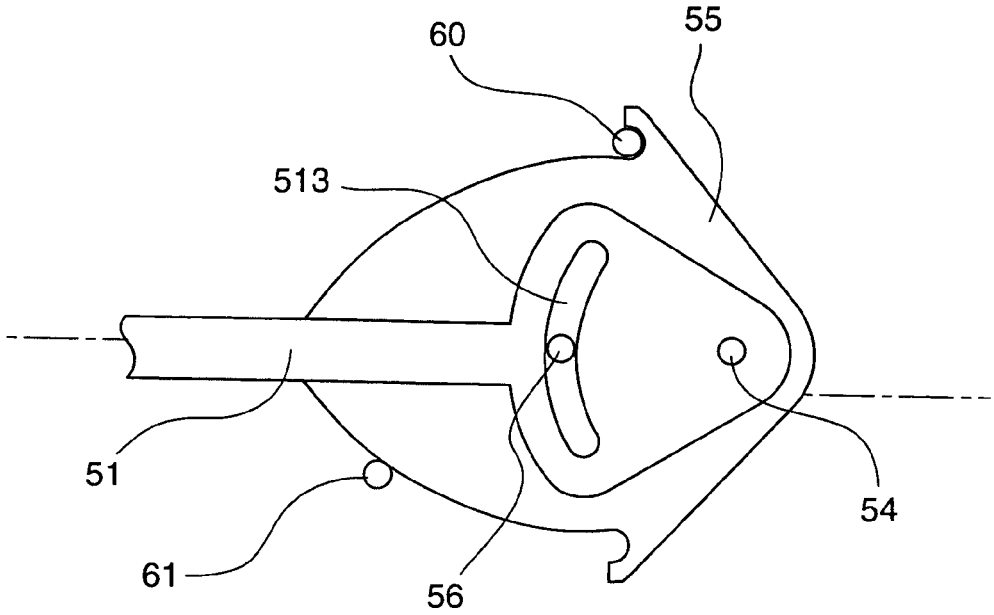
Figure 10B:
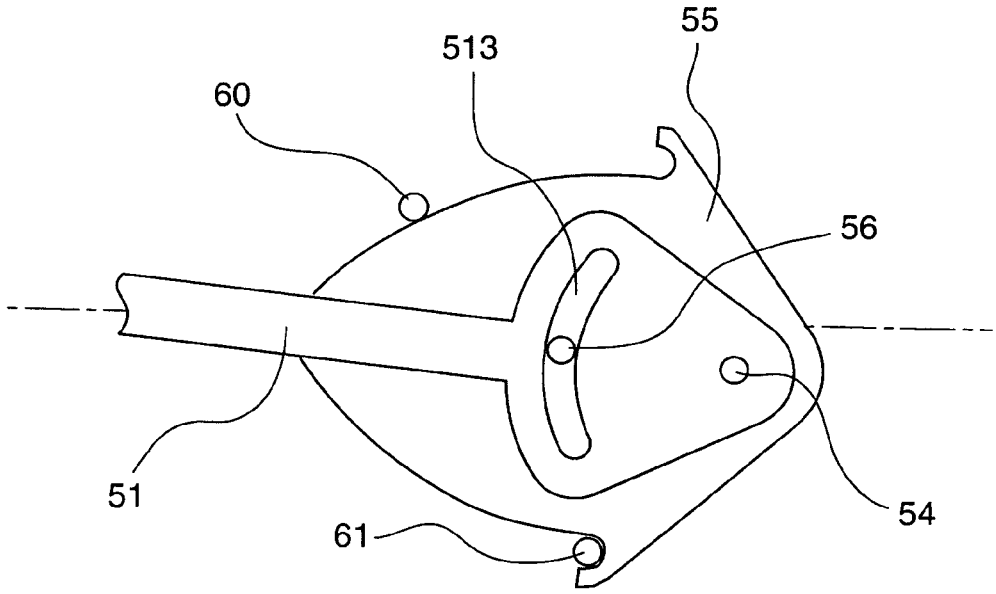
Figure 10C:
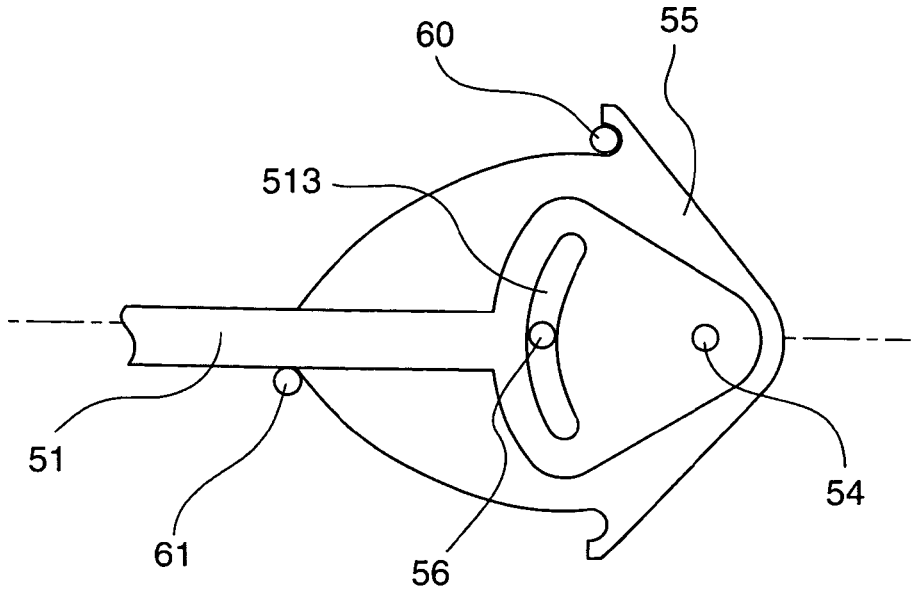
Figure 11A:
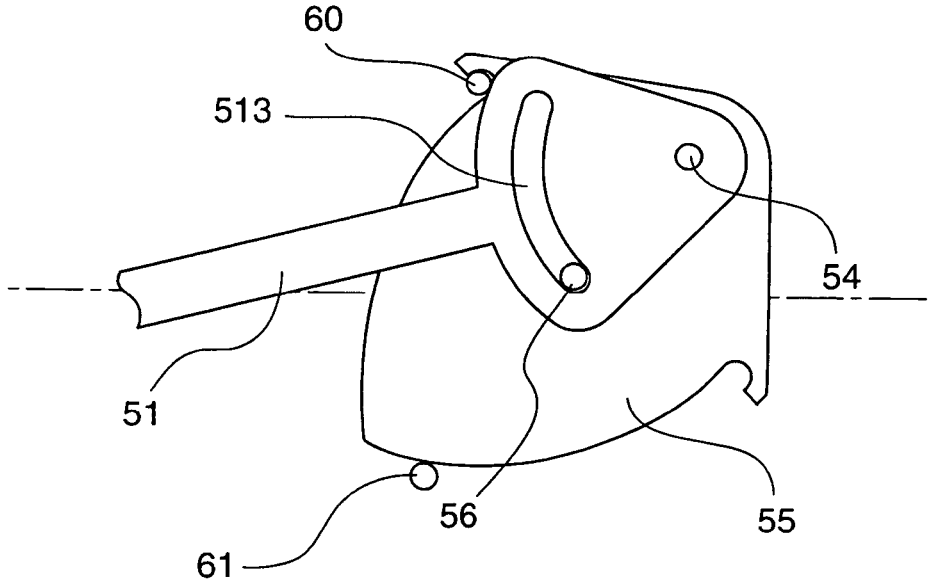
Figure 11B:
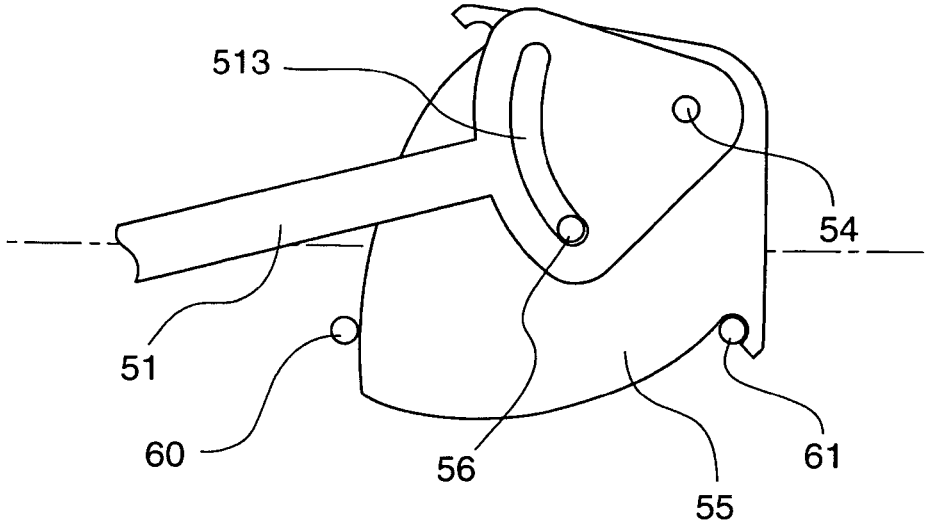
Figure 16:
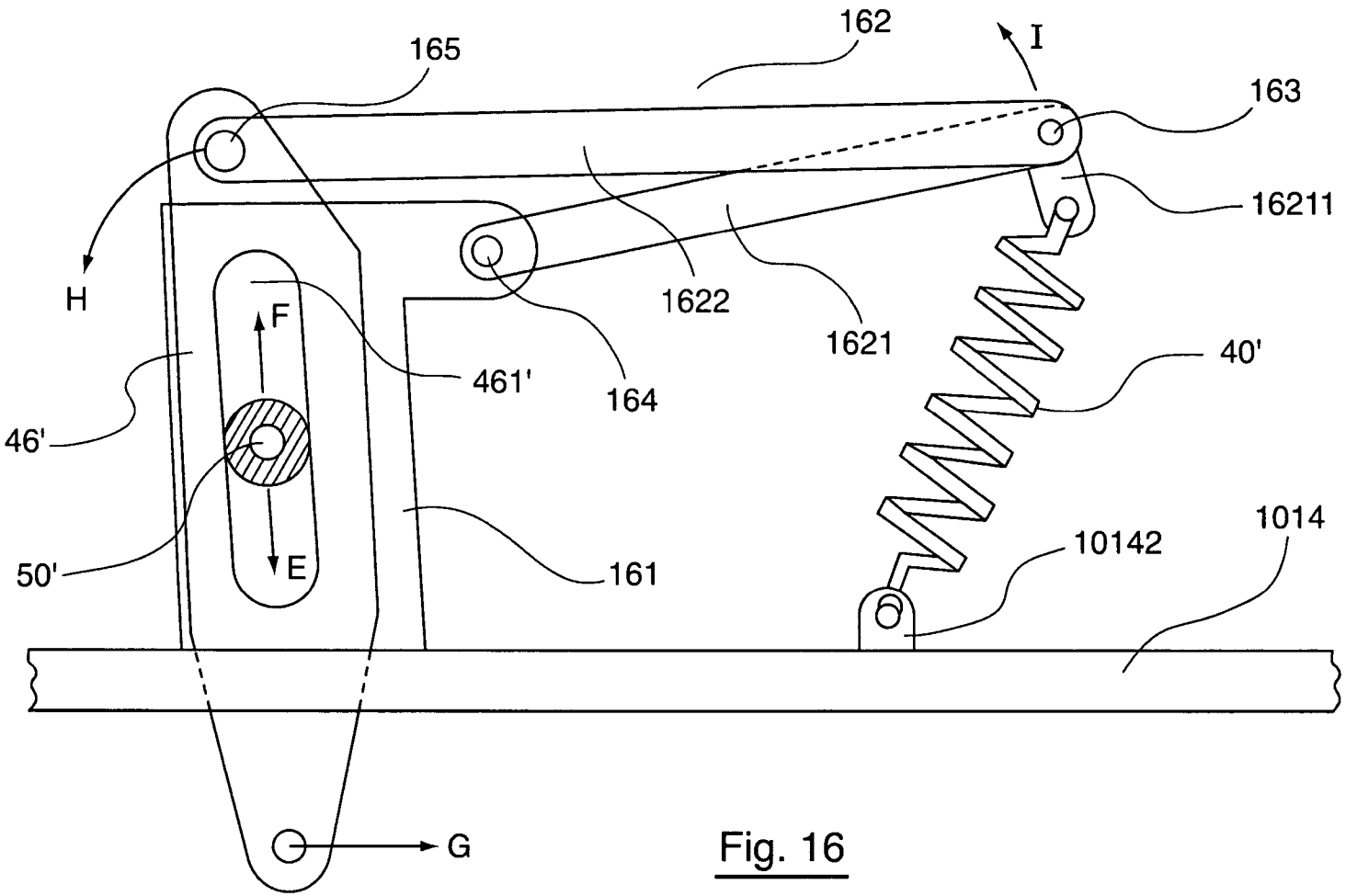

FIGS. 8*a*, 8*b*, 8*c* illustrate three different start positions (respectively start position 1, start position 2, start position 3) of the mechanical link means according to the invention;

FIGS. 9*a*, 9*b* show different states of the mechanical link means when the weight-training machine is used from start position 1;

FIGS. 10*a*, 10*b*, 10*c* illustrate different states of the mechanical link means when the weight-training machine is used from start position 2;

FIGS. 11*a*, 11*b* show different states of the mechanical link means when the convertible gym training device is used from start position 3;

FIGS. 12*a* to 12*f* show different configurations of the convertible gym training device according to the present invention that allow a user to do training exercise for different groups of muscles;

FIGS. 13*a* and 13*b* are different graphs showing load variation when the convertible gym training device is used from start position 1 depending on the direction of the rotation in which the arm actuator is pivoted;

FIG. 14 is a graph showing load variation when the convertible gym training device is used from start position 2 depending on the direction of the rotation in which the arm actuator is pivoted;

FIGS. 15*a* and 15*b* are different graphs showing load variation when the convertible gym training device is used from start position 3 depending on the direction of the rotation in which the arm actuator is pivoted;

FIG. 16 illustrates an alternative embodiment of the first transmission sub-assembly and return means which may be implemented in a convertible gym training device according to the invention.

6. DETAILED DESCRIPTION OF THE INVENTION

6.1 Principle of the Invention

The principle of the invention concerns a convertible gym training device intended to be removably connected to a weight-training machine and that allow a user to do lower and upper limb working exercises. To make this possible, the convertible gym training device according to the invention can be equipped with some working accessories selectively used to do upper or lower limb working exercises and has different working positions:

- a first working position in which the force which a user needs to apply on a working accessory increases or decreases according to the direction of rotation of the working accessory;
- a second working position in which the force which a user needs to apply on a working accessory increases and then decreases in both direction of rotation of the working accessory;
- a third working position in which the force which a user needs to apply on a working accessory increases or decreases according to the direction of rotation of the working accessory, but in an opposite direction comparatively to the first working position (it means that if the force applied by the user in the first working position increases when the accessory is pivoted in a clock-wide direction, the force applied by the user in the third working position will increases when the accessory will be pivoted in an anti clock-wise direction).

6.2 Structure of the Convertible Gym Training Device According to the Invention

6.2.1 Base Structure

In the following part of the description hereafter, weight-training machine refers to a weight-training bench to which is connected a convertible gym training device according to the invention.

Figure 1A:
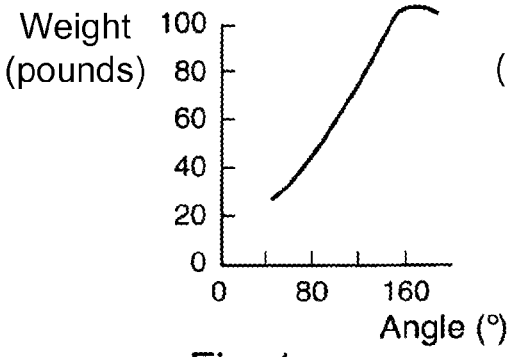
Figure 1B:
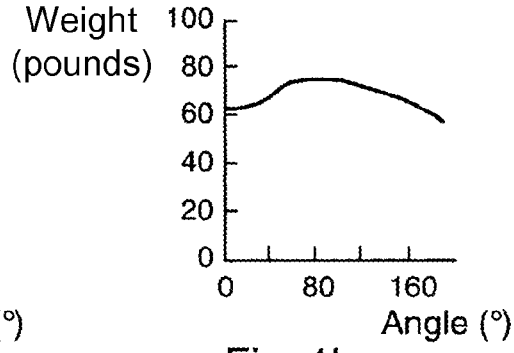
Figure 2:
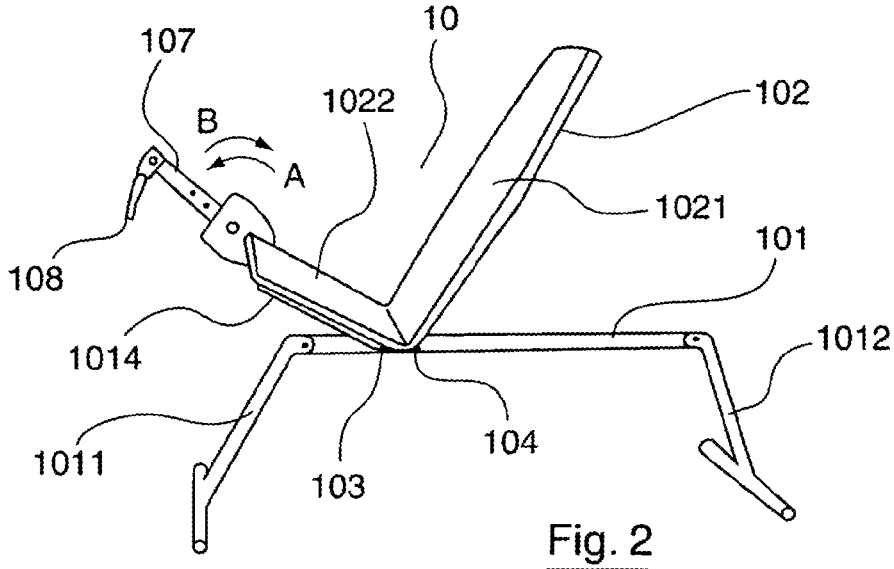

A weight-training machine to which is removably connected a convertible gym training device according to the present invention is generally illustrated in FIG. 2. The weight-training machine 10 comprises a cross piece 101 to which are pivotally attached two "T" shaped legs 1011, 1012. A support 102 for supporting a user is composed of a first plate 1021 and a second plate 1022. The second plate 1022 is supported by a frame 1014 that is pivotally attached to the cross piece 101 by a pivot 103. The first plate 1021 is linked to the cross piece 101 by pivot 104. The inclination relative to the cross piece 101 of the first and the second plate can thus be changed.

The weight-training machine according to the present invention comprises an arm actuator 107 pivotally attached to the frame 1014 so that it can turn according to arrow A and arrow B. A pull-push rod 108 or a handlebar 109, on which a user can pull and/or push to do a training exercise, could be attached to the arm actuator 107. The choice to assemble either a pull-push bar 108 or a handlebar 109 with the arm actuator 107 depends on the type of training exercise a user needs to do as it will be explained hereafter.

Resilient return means 40, a first transmission sub-assembly, mechanical link means 400 and a second transmission sub-assembly, that will be later described, are connected to the arm actuator 107 in such a way that it transmits a back moving force to the arm actuator 107 so as to resist to the arm actuator's rotation.

Figure 3:
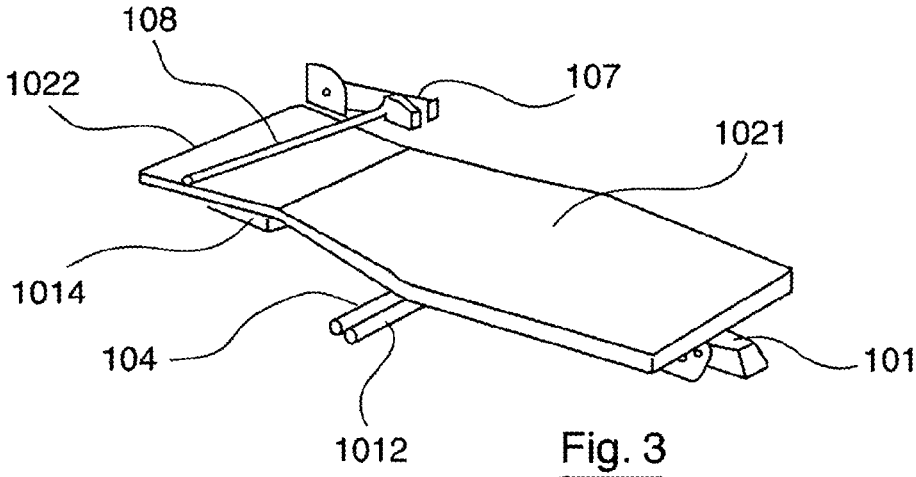
FIG. 3 illustrates the weight-training machine of the FIG. 2 shown in a folded position.

FIG. 3 illustrates the weight-training machine according to the present invention in its folding position. In this folding position, the first plate 1021, the second plate 1022, and the two "T" shaped legs 1011, 1012 abut against the cross piece 101, and the arm actuator 107 is folded along the second plate 1022.

6.2.2 First Transmission Sub-Assembly and Resilient Return Means

Figure 4:
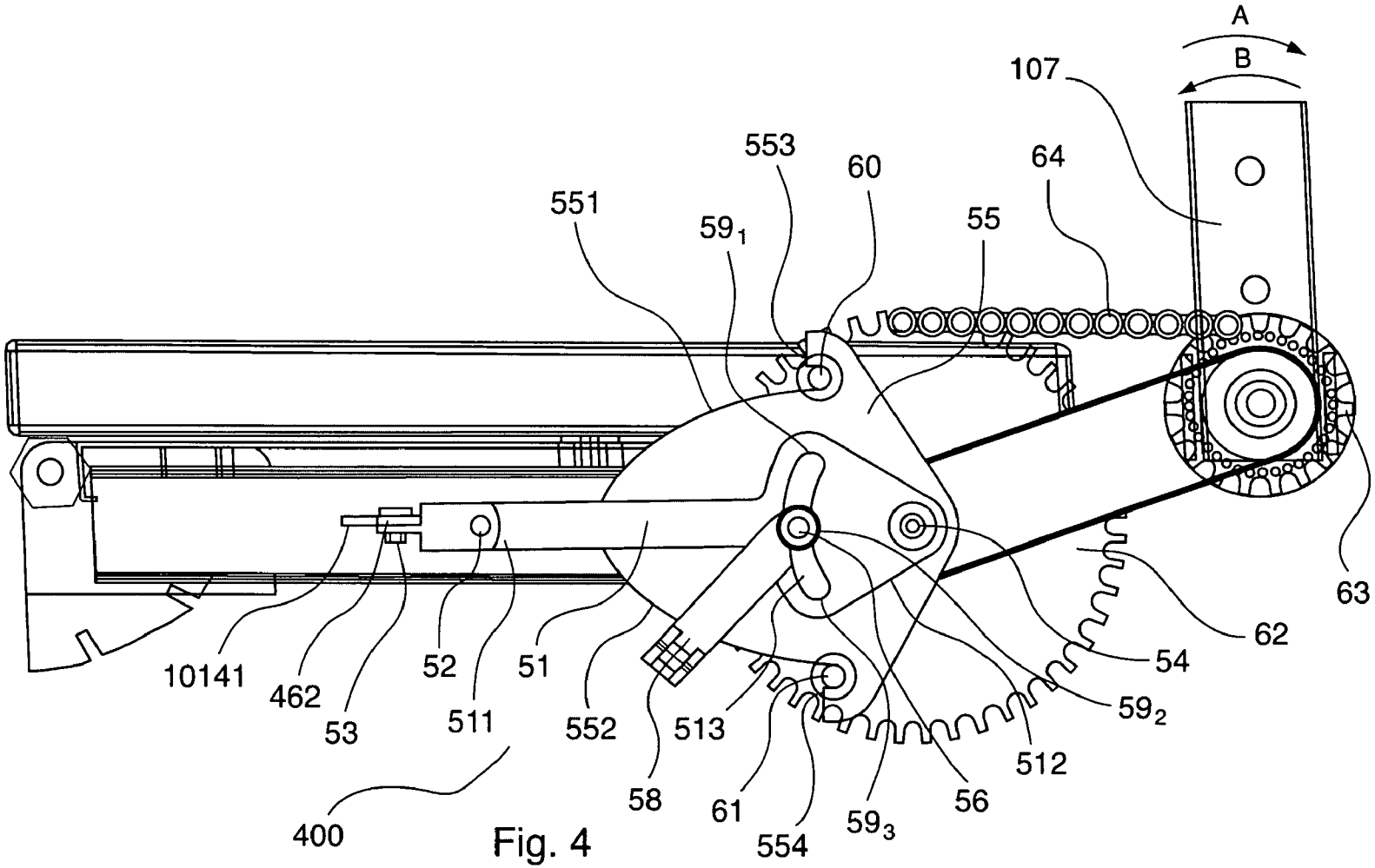
FIG. 4 illustrates a partial side view of a convertible gym training device according to the invention.
Figure 5:
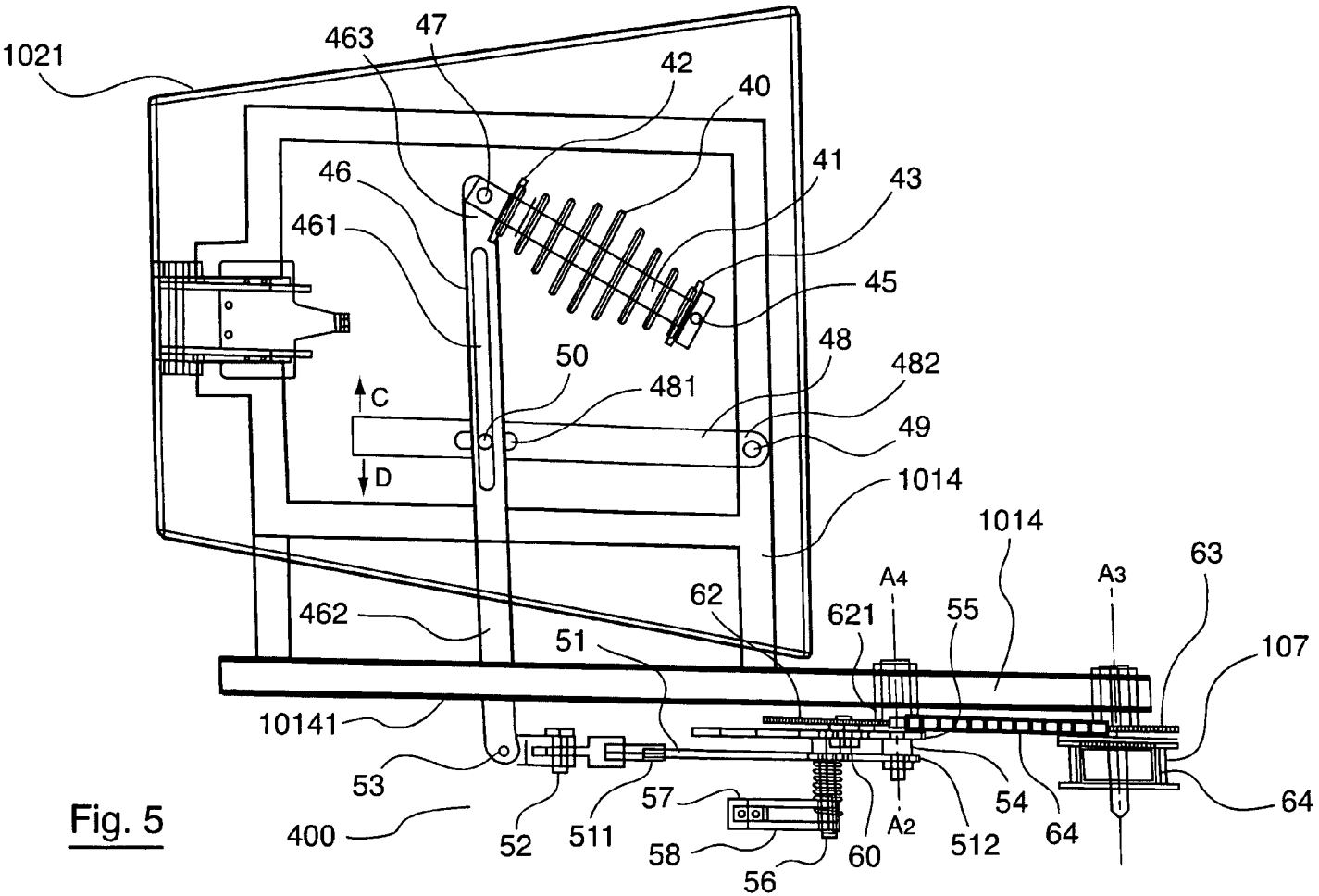
FIG. 5 illustrates a top view of a convertible gym training device of FIG. 4.
Figure 6:
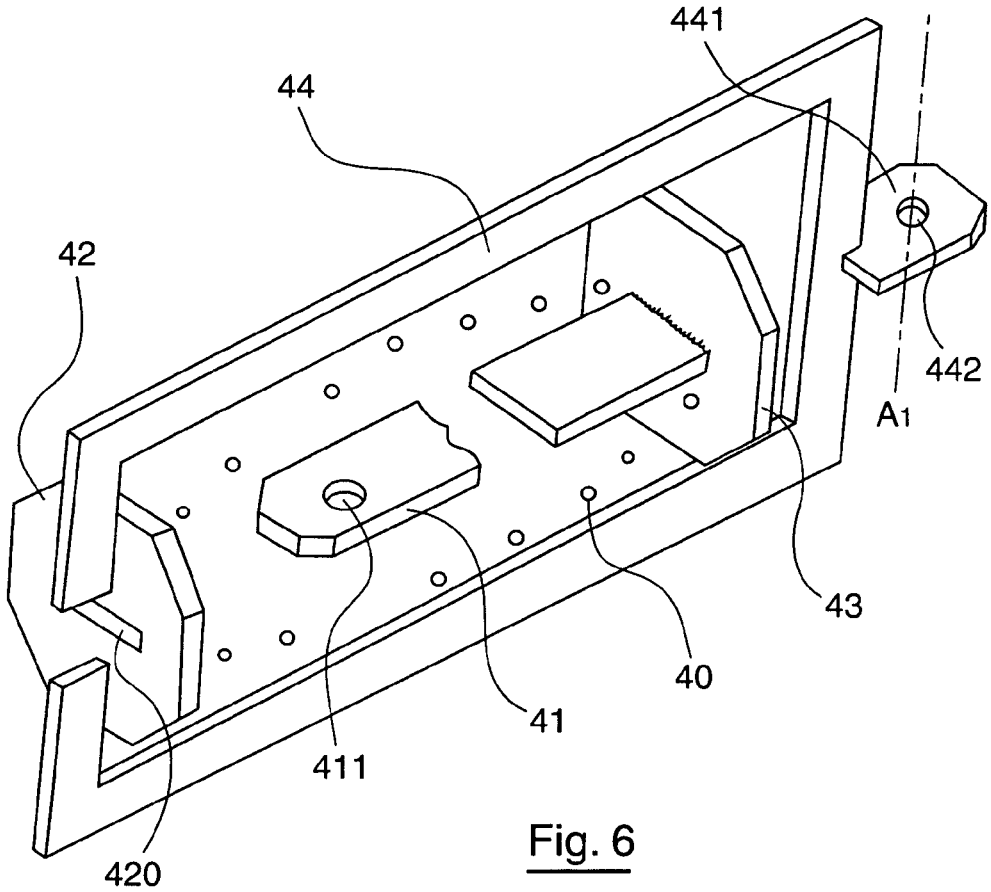
FIG. 6 shows an embodiment of the spring arrangement illustrated in FIG. 5.

The First transmission sub-assembly and resilient return means according to the invention will be described hereafter in relation with FIGS. 4, 5 and FIG. 6.

Resilient return means, for example a simple coil compression spring 40, is threaded along a bar 41. Each extremity of the spring 40 abuts against cub 42, 43. One extremity of the bar 41 is fixedly connected to the cub 43 and the other extremity can slide inside on opening 420 on the cub 42. The cub 42 is fixedly connected to a "C" shaped frame 44 that have an attachment 441 with an anchor hole 442. The "C" shaped frame 44 is pivotally attached to the frame 1014 with a rod 45 that passes through the hole 442 so that it can turn around axis A1. The bar 41 is pivotally connected to an extremity 463 of an articulated rod 46 with a pivot 47 which passes trough the hole 411 of the bar 41. The articulated rod 46 has a guiding slot 461 on a fraction of its length. The extremity 462 of the articulated rod 46 can slide inside an opening 10141 in the frame 1014.

An adjustment lever 48 is linked to the frame 1014 with a pivot 49. The adjustment lever 48 has an opening 481. The articulated rod 46 and the adjustment lever 48 are linked together with a pin point 50 that passes through the guiding slot 461 and the opening 481 and that can slide along these guiding slot 461 and opening 481 so that the adjustment lever 48 can be displaced according to arrow C and D.

The articulated rod 46 and the adjustment lever 48 form a load transmission linkage mechanism.

6.2.3 Mechanical Link Means

The mechanical link means 400 comprises a connecting rod 51. The connecting rod eye 511 of the connecting rod 51 is connected to the extremity 462 of the articulated rod 46 by two pivots 52, 53. The connecting rod head 512 of the connecting rod 51 is connected to a drive plate 55 with a pivot-arm 54 fixedly attached to the drive plate 55 so that it can freely turn around an axis A2 relatively to the drive plate 55. An arc-shaped opening 513 crosses the connecting rod 51.

The drive plate 55 has two cam profiles 551, 552 and two connecting housing 553, 554.

6.2.4 Second Transmission Sub-Assembly

Two drive pins 60, 61 link the drive plate 55 to a second idler drive 62 that is pivotally attached to the frame 1014 around axis A4, in such a way that the drive plate 55 can turn around the drive pins 60 or 61.

A first drive cog 63 is fixedly attached to the arm actuator 107 with a multi position mechanism that allows changing the angle between the first drive cog 63 and the arm actuator 107.

The second idler drive 62 and first drive cog 63 are linked together by means of a driving chain 64. Only a portion of the driving chain 64 is represented on FIG. 4.

Of course, other sorts of drive mechanism could be used. For example, belt drive or gear drive can be implemented instead of chain drive. These approaches may in particular allow reducing the weight of the convertible gym-training device according to the invention.

6.2.5 Locking Mechanism

Figure 7:
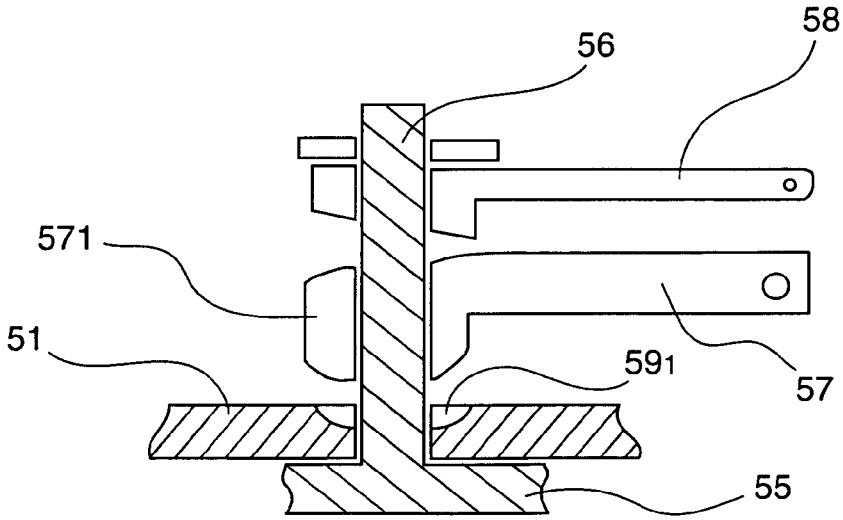
FIG. 7 shows a partial view of the locking-mechanism according to the invention.

The mechanical link means 400 comprises a locking mechanism shown on FIG. 7. This locking mechanism may be set in two different states:

an unlocked state in which connecting rod 51 may freely turn around axis A2;

a locked state in which drive plate 55 and connecting rod 51 are fixedly attached with each other.

Three locking housings $\mathbf{59}_1$, $\mathbf{59}_2$, $\mathbf{59}_3$ are equally disposed over the arc-shaped opening 513.

A threaded locking arm 56 is fixedly connected to the drive plate 55 and passes through the arc-shaped opening 513. A first locking handle 57 with an extension 571 is slidably mounted on the locking arm 56. A second locking handle 58 is bolted on the locking arm 56 so that screwing of the second locking handle 58 causes the first locking handle 57 to slide along the locking arm 56 and the extension 571 to penetrate inside one of the locking housings $\mathbf{59}_1$, $\mathbf{59}_2$or $\mathbf{59}_3$.

In such a penetration position, the connecting rod 51 and the drive plate 55 are fixedly attached to each other.

6.3 Operation of the Weight-Training Machine According to the Invention

Operation of the weight-training machine according to the invention will now be described.

6.3.1 Mechanical Link Means Adjustment and Start Positions

As an advantageous feature of the invention, the force a user needs apply to rotate the arm actuator 107 varies during its rotation so that it allows a user to perform a wide variety of muscle training exercises.

Three different start positions (named start position 1, start position 2 and start position 3) can be chosen by a user according to the type of exercises he wants to do. These different start positions are respectively illustrated by FIGS. 8*a*, 8*b* and 8*c*.

The locking mechanism described in § 6.2.5 needs to be in its unlocked state to shift from one start position to another. As already described, in such an unlocked state, the connecting rod 51 and the drive plate 55 are pivotally attached to each other so that the connecting rod 51 and the drive plate 55 can independently turn around the axis A2.

To pass from start position 2 (FIG. 8*b*) to start position 1 (FIG. 8*a*), after the locking mechanism has been put in its unlocked state, the arm actuator 107 is rotated according to arrow A. The drive plate 55, driven by the drive pins 60, 61 rotates around axis A2 until the locking arm 56 that slides inside the arc-shaped opening 513, abuts against an extremity of the arc-shaped opening 513 and the locking handle 57, 58 are above of the locking housing $\mathbf{59}_1$. During this movement, the connecting rod 51 remains in the same position. Then the locking mechanism is put in its locked state (as described in § 6.2.5) so that the extension 571 penetrates inside the locking housing $\mathbf{59}_1$ and the connecting rod 51 and the drive plate 55 are fixedly attached to each other.

To pass from position 1 to position 2, the locking mechanism is unlocked, the arm actuator 107 is then rotated according to arrow B until the locking handle 57, 58 are above the locking housing $\mathbf{59}_2$. The locking mechanism may then be locked.

To pass form start position 2 to start position 3 (FIG. 8*c*), the locking mechanism is unlocked, the arm actuator 107 is turned according to arrow B until the locking handle 57, 58 are above the locking housing $\mathbf{59}_3$. Then the locking mechanism is locked.

It is possible to pass from any of the start positions to any other position without following the sequence described above.

6.3.2 Operation of the Device During a Training Exercise

Operation of the weight-training machine according to the invention during a training exercise will now be described in relation to FIG. 8*a* to FIG. 11*b*.

6.3.2.1 Operation of the Machine Set in Start Position 1.

In start position 1, when a user pushes the arm actuator 107 to rotate it according to arrow B, the second idler drive 62 turns around axis A4. The drive pin 61 drives the drive plate 55 that progressively turns around the drive pin 61 and tracts the connecting rod 51. During this movement, the drive pin 60 slides along the cam profile 551. The connecting rod 51 pulls the articulated rod 46 that rotates around pin point 50. During its rotation, the articulated rod 46 pulls the bar 41 and compresses the compressing spring 40 that generates a force opposed to the rotation of the arm actuator 107. At the end of the training exercise, the transmission means are in the position illustrated by FIG. 9*b*.

During this training exercise, the force a user needs to apply on the arm actuator 107 to rotate it according to arrow A decreases as is shown on FIG. 13*a*.

In start position 1, when a user pushes the arm actuator 107 to rotate it according to arrow B, the second idler drive 62 turns around axis A4. The drive pin 61 drives the drive plate 55 that progressively turns around the drive pin 61 and tracts the connecting rod 51. During this movement, the drive pin 60 slides along the cam profile 551. The connecting rod 51 pulls the articulated rod 46 that rotates around pin point 50. During its rotation, the articulated rod 46 pulls the bar 41 and compresses the compressing spring 40 that generates a force opposed to the rotation of the arm actuator 107. At the end of the training exercise, the transmission means are in the position illustrated by FIG. 9*b*.

During this training exercise, the force a user needs to apply on the arm actuator 107 to rotate it according to arrow B increases (FIG. 13*b*).

6.3.2.2 Operation of the Machine Set in Start Position 2.

In start position 2, the operation of the weight-training machine is the same as in start position 1.

The force a user needs to apply on the arm actuator 107 to turn it according to arrow A as according to arrow B firstly increases and then decreases as is shown in FIG. 14.

FIG. 10*a* illustrates an intermediate position of the drive plate 55 when the arm actuator 107 is rotated according to arrow A. FIG. 10*b* illustrates an intermediate position of the drive plate 55 when the arm actuator 107 is rotated according to arrow B. FIG. 10*c* illustrated the final position of the drive plate 55 when the arm actuator 107 is rotated according to arrow A.

6.3.2.3 Operation of the Machine Set in Start Position 3.

When the weight-training machine is used from start position 3, the same mechanical effects occur as when it is used from start position 1 but the force directions are reversed.

When the arm actuator 107 is rotated according to arrow A, the force a user needs to apply increases (FIG. 15 *a*). When the arm actuator 107 is rotated according to arrow B, the force a user needs to apply decreases (FIG. 15*b*).

FIG. 11*a* illustrates the final position of the drive plate 55 when the arm actuator 107 is rotated according to arrow A. FIG. 11*b* illustrates the final position of the drive plate 55 when the arm actuator 107 is rotated according to arrow B.

6.3.3 Load Adjustment

All users of a weight-training machine do not have the same physical condition and cannot displace identical loads. For example a strong adult user and a weaker child user do not have equal power.

To change the reference load that is the maximum load a user will displace during an exercise, an extremity 482 of the adjustment lever 48 may be rotated around the pivot 49 according to arrow C or D. The more the adjustment lever 48 is rotated according to arrow C the higher will be the reference load. Conversely, the more the adjustment lever is rotated according to arrow D, the lower will be the reference load.

6.4 Alternative Embodiment

FIG. 16 illustrated another embodiment of the first transmission sub-assembly and return means according to the invention.

In such an embodiment, a fixed bracket 161 is fixedly connected to the frame 1014. An articulated rod 46' is connected to the fixed bracket 161 by a pin point 50' that passes through the guiding slot 461' in such a way that the articulated rod 46' can rotate around the pin point 50'.

A compass 162 consists of a first rod 1621 and a second rod 1622. Compass 162 links the fixed bracket 161 and the articulated rod 46' together. First 1621 and second 1622 rod are connected by a hinge 163 at one of their ends. The other extremity of the first 1621 and second 1622 rods are respectively connected to the fixed bracket 161 by a pivot 164, and to the articulated rod 46' by a pivot 165.

The first rod 1621 presents a lug 16211 to which is connected one end of the spring 40'. The other end of the spring 40' is connected to the ridge 10142 of the frame 1014.

When a user acts on the arm actuator 107 to do a training exercise, he exerts a force G on the articulated rod 46' through the second transmission sub-assembly and the mechanical link means 400 so that the articulated rod 46' rotates around pin point 50'. The articulated rod 46' pulls the second rod 1622 of the compass 162 according to arrow H. The first rod 1621 turns around the pivot 164 and the hinge 163 is displaced according to arrow I so that the compass streches the extension spring 40'.

To adapt the load to the user (weaker, stronger . . . ) the pin point 50' can be displaced inside the guiding slot 461' according to arrows E and F.

6.5 Applications of the Weight-Training Machine According to the Invention

FIGS. 2 and 12*a* to 12*f* illustrate different configurations of the weight-training machine according to the present invention that allows a user to do training exercises for different groups of muscles.

FIG. 2 illustrates such a configuration to do leg flexion. In such a configuration, the first plate 1021 is used as a backrest and the second plate 1022 is used as a seat. The push-pull rod 108 is attached to the arm actuator 107 and a user pulls with his legs the pull-push rod 108 to rotate arm actuator 107 according to arrow A.

The load a user's leg is able to displace increases with its angle of flexion. During a leg-flexion exercise, the load has to increase. So, to do this type of exercise, the convertible gym-training device must be set in start position 3.

Figure 12A:
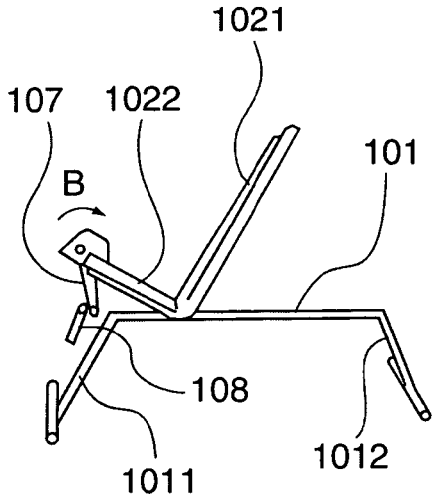

FIG. 12*a* illustrates another configuration setting to do leg extension. In such a configuration, the first plate 1021 is used as a backrest and the second plate 1022 is used as a seat. The push-pull rod 108 is attached to the arm actuator 107 and a user pushes with his legs the pull-push rod 108 to rotate the arm actuator 107 according to arrow B.

As it has already been explained, the load a user's leg is able to displace increases with its angle of flexion. During a leg-extension exercise, the load has to decrease. To do this type of exercise, the convertible gym-training device must be set in start position 3.

Figure 12B:
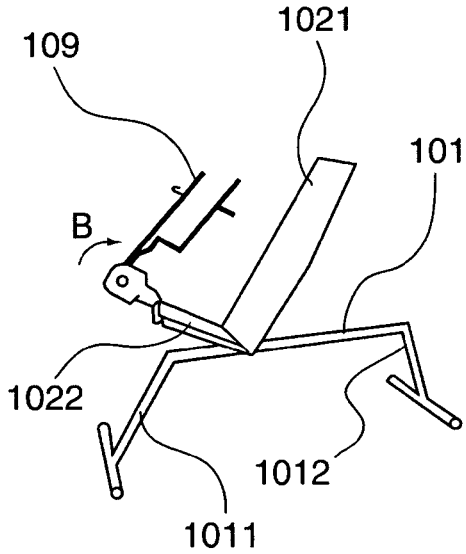

FIG. 12*b* illustrates another setting to do shoulder press. In such a configuration, the first plate 1021 is used as a backrest and the second plate 1022 is used as a seat. The handle bar 109 is fixedly connected to the arm actuator 107 and the user can pull the handle bar 109 to rotate the arm actuator 107 according to arrow B.

To do a shoulder press exercise, the convertible gym device must be set in position 2 as the load a user is expected to displace during this type of exercise firstly increases and then decreases.

Figure 12C:
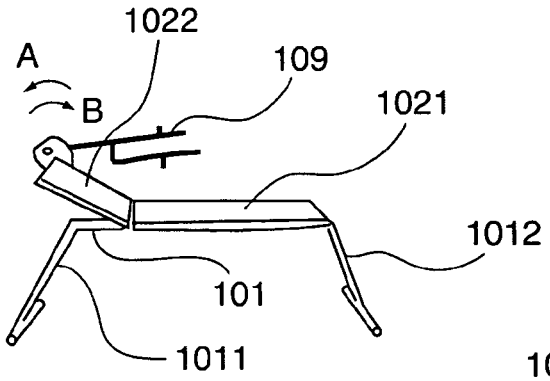

FIG. 12*c* illustrates another setting to do dips/raises. In such a configuration, the first plate 1021 acts as a backrest and the second plate 1022 acts as a headrest. The handle bar 109 is attached to the arm actuator 107 and a user can alternatively pull and push the handlebar 109 to rotate the arm actuator 107 according to arrow A and to arrow B.

To do this type of exercise, the convertible gym-training device must be set in start position 2 as the load a user is expected to displace during this type of exercise firstly increases and then decreases.

Figure 12D:
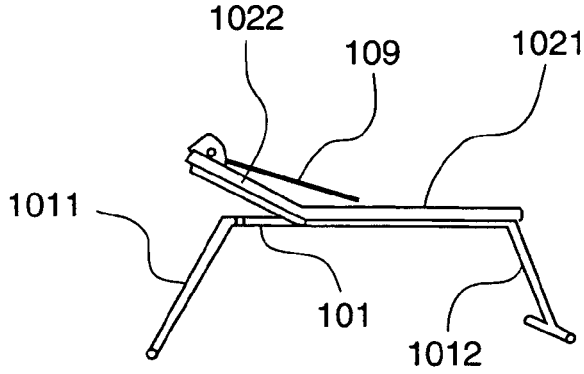

Commonly, to do an exercise that involves use of shoulder and/or hip, the convertible gym training device according to the invention must be set in position 2 in order the load displaced by the user during an exercise increases and the decreases. This is because the primary muscle groups in these exercises are different to simple extensor and flexor muscles of the arms and legs. The position of attachment of shoulder and hip/thigh muscles around a socket joint as in hips and shoulders is such that the lever principle is not so prevalent as in the elbow and knee joints. FIG. 12*d* illustrates an alternative setting to the setting that is illustrated by FIG. 12*c*, that allow a user to do dips.

Figure 12E:
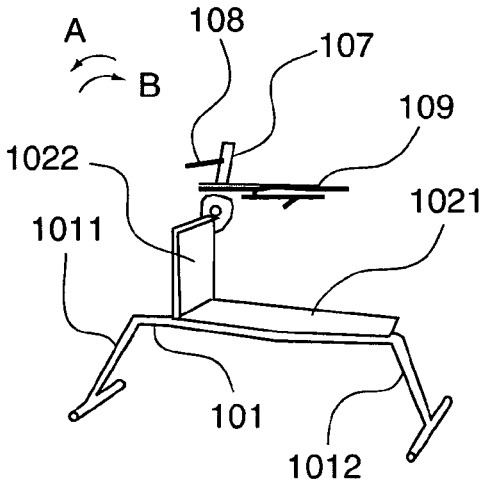
Figure 12F:
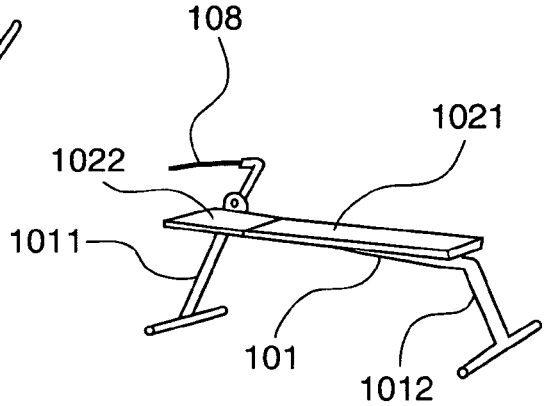

FIG. 12*e* illustrate another setting to do arm raise/pull. In such a configuration, the first plate 1021 acts as a seat and the second plate 1022 acts as a backrest. The handlebar 109 is attached to the arm actuator and a user can alternatively pull and push the handlebar 109 to rotate the arm actuator according to arrow A and to arrow B.

To do this type of exercise, the convertible gym-training device must be set in start position 2 as the load a user is expected to displace during this type of exercise firstly increases and then decreases. A setting to do leg/thigh push is illustrated on FIG. 12*f*. In such a configuration, first and second plates 1021, 1022 likely form a bench. The pull-push rod 108 is fixedly connected to the arm actuator 107 and a user can push the pull-push rod 108 with his legs or his thighs to rotate the arm actuator 107.

To do this type of exercise, the convertible gym-training device must be set in start position 2 as the load a user is expected to displace during this type of exercise firstly increases and then decreases. As it has been described above, the weight-training machine according to the invention allows a user to do different muscles training exercises. In particular, a user using such a weight-training machine can do upper limb working exercises and lower limb working exercises.

Muscular training is not just for sport but has a place in maintaining ones health. As the weight-training machine according to the invention can be used as a physiotherapy tool, it also brings the user health related benefits.

The invention claimed is:

1. Convertible gym training device intended to be removably connected to a weight-training device that permits training of lower and upper body limbs, characterised in that it comprises:

an essentially quadrangular frame;

an arm actuator rotatably connected to the frame;

resilient return means opposing a force against the rotation of the arm actuator relative to the frame;

mechanical link means connecting the arm actuator with the resilient return means, said mechanical link means being designed to oppose a variable back moving force against the arm actuator, all along its rotation travel, said back moving force being variable according to a predetermined load curve, the mechanical link means comprising a connecting rod cooperating with a drive plate, said connecting rod comprising:

a connecting rod head fixedly connected to said drive plate according to one of at least two removable locking positions, each of said two removable locking positions corresponding to a different predetermined variable load curve for said back moving force;

a connecting rod eye acting on said resilient return means via a first transmission sub-assembly, and in that said drive plate is driven in rotation by a second transmission sub-assembly, said second transmission sub-assembly being connected to said arm actuator.

2. Convertible gym training device according to claim 1, characterized in that said first transmission sub-assembly comprises a load transmission linkage mechanism for transmitting said variable back moving force, said linkage mechanism being adjustable according to one of at least two positions, each said positions corresponding to a different intensity for the load curve of said variable back moving force which is transmitted.

3. Convertible gym training device according to claim 2, characterised in that the linkage mechanism comprises:

an articulated rod, said articulated rod having a first end and a second end, said first end being connected to the resilient return means, and said second end being slidably connected relative to the frame, the articulated rod having a guiding slot extending along at least a part of its length;

an adjustment lever having a first extremity and a second extremity, said first extremity being guided along said guiding slot, said second extremity being rotatably connected to said frame.

4. Convertible gym training device according to claim 1, characterized in that said second transmission sub-assembly comprises a drive wheel, said drive wheel cooperating with said drive plate and comprising at least one drive pin, said drive pin being able to drive said drive plate.

5. Convertible gym training device according to claim 4, characterized in that said drive plate has at least one cam profile, and in that the said drive wheel comprises two drive pins that are symmetrically positioned, at least one of the drive pins guiding the movement of said drive plate by engaging said cam profile, while the other drive pin drives said drive plate.

6. Convertible gym training device according to claim 4, characterised in that it comprises a first drive cog solidably connected to said arm actuator, and in that said drive wheel consists of a second idler drive which is rotatably connected relative to said frame and acts on said drive plate when said arm actuator is pivoted relative to the frame, said first drive cog engaging said second idler drive by means of a driving chain.

7. Convertible gym training device according to claim 4, characterized in that said drive wheel and said drive plate are set coaxially to each other when said arm actuator stands in a rest position, said rest position corresponding to a neutral position in which said resilient return means do not oppose any force against the rotation of the arm actuator relative to the frame.

8. Weight-training bench, characterised in that it comprises a bench to which is affixed a convertible gym training device according to claim 1.

9. Convertible gym training device according to claim 1, wherein said connecting rod head is fixedly connected to said drive plate according to one of three removable locking positions, each of said three removable locking positions corresponding to a different predetermined variable load curve for said back moving force according to three different working positions.

10. Convertible gym training device according to claim 1, wherein the at least two different predetermined variable load curves for said back moving force each have a different shape.

11. Convertible gym training device according to claim 1, wherein the at least two different predetermined variable load curves comprise:

a first load curve for the back moving force which increases or decreases according to the direction of rotation of the arm actuator; and a second load curve for the back moving force which is one of the following:

a load curve which increases and then decreases in both directions of rotation of the arm actuator; or a load curve which increases or decreases according to the direction of rotation of the arm actuator but in an opposite direction comparatively to the first load curve.

* * * * *

UNITED STATES PATENT AND TRADEMARK OFFICE

CERTIFICATE OF CORRECTION

PATENT NO. : 7,691,038 B2
APPLICATION NO. : 11/959457
DATED : April 6, 2010
INVENTOR(S) : Stuart Laurence Shearer It is certified that error appears in the above-identified patent and that said Letters Patent is hereby corrected as shown below:

At Col. 8, line 13, delete "arrow B", and insert therefor --arrow A--.

At Col. 8, line 14, delete "pin 61", and insert therefor --pin 60--.

At Col. 8, line 15, delete "pin 61", and insert therefor --pin 60--.

At Col. 8, line 16, delete "pin 60", and insert therefor --pin 61--.

At Col. 8, line 17, delete "profile 551", and insert therefor --profile 552--.

At Col. 8, line 19, delete "and", and insert therefor --that--.

At Col. 8, line 20, delete "that", and insert therefor --between cubs 42, 43 and--.

At Col. 8, line 21, after "107.", insert --The spring 40 is a compression spring that has a double conical design that allows the spring 40 to be compressed into a small distance.--

At Col. 8, line 23, delete "FIG. 9b", and insert therefor --FIG. 9a--.

Signed and Sealed this

Twenty-third Day of November, 2010

David J. Kappos

David J. Kappos
*Director of the United States Patent and Trademark Office*